US010094199B2

(12) United States Patent
Vick, Jr.

(10) Patent No.: US 10,094,199 B2
(45) **Date of Patent: *Oct. 9, 2018**

(54) PROTECTION OF A SAFETY VALVE IN A SUBTERRANEAN WELL

(71) Applicant: HALLIBURTON ENERGY SERVICES, INC., Houston, TX (US)

(72) Inventor: James D. Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 413 days.

This patent is subject to a terminal disclaimer.

(21) Appl. No.: 13/908,899

(22) Filed: Jun. 3, 2013

(65) Prior Publication Data

US 2013/0264062 A1 Oct. 10, 2013

Related U.S. Application Data

(63) Continuation of application No. 13/633,273, filed on Oct. 2, 2012, now Pat. No. 8,479,826.

(30) Foreign Application Priority Data

Oct. 20, 2011 (WO) ..... PCT/US11/57117

(51) Int. Cl.
*E21B 34/08* (2006.01)
*E21B 34/06* (2006.01)
(Continued)

(52) U.S. Cl.
CPC ..... *E21B 34/06* (2013.01); *E21B 34/08* (2013.01); *E21B 34/10* (2013.01); *E21B 34/14* (2013.01); *E21B 2034/005* (2013.01)

(58) Field of Classification Search
CPC .... E21B 2034/005; E21B 34/08; E21B 34/14; E21B 34/10; E21B 21/10
See application file for complete search history.

(56) References Cited

U.S. PATENT DOCUMENTS 3,094,170 A 6/1963 Bourne, Jr.
3,713,485 A 1/1973 Holbert, Jr.
(Continued)

FOREIGN PATENT DOCUMENTS

GB 336323 A 10/1930
GB 772690 A 4/1957
(Continued)

OTHER PUBLICATIONS

Office Action dated Mar. 12, 2007 for U.S. Appl. No. 11/041,393, 8 pages.
(Continued)

*Primary Examiner* — D. Andrews
(74) *Attorney, Agent, or Firm* — Locke Lord LLP

(57) ABSTRACT

A safety valve system for use in a subterranean well can include a safety valve protector connected downstream of a safety valve, whereby when closed the safety valve protector reduces a flow rate through the safety valve and prevents displacement of an object through the safety valve protector to the safety valve. Another safety valve system can include a safety valve protector which, when closed, reduces a flow rate through a safety valve, and the safety valve protector closes in response to the flow rate through the safety valve being above a predetermined level. In another safety valve system, each of the safety valve protector and the safety valve comprises an actuator, the actuators being connected by a line, and a signal transmitted by the line causes the safety valve protector actuator to close the safety valve protector, and then causes the safety valve actuator to close the safety valve.

7 Claims, 8 Drawing Sheets

(51) Int. Cl.

| | |
|---|---|
| ***E21B 34/10*** | (2006.01) |
| ***E21B 34/14*** | (2006.01) |
| *E21B 34/00* | (2006.01) |

(56) References Cited

U.S. PATENT DOCUMENTS

| | | | | |
|---|---|---|---|---|
| 3,726,341 | A | 4/1973 | Holbert, Jr. | |
| 3,771,603 | A | 11/1973 | Crowe | |
| 3,848,669 | A | 11/1974 | Brown | |
| 4,128,106 | A | 12/1978 | Abercrombie | |
| 4,183,404 | A | 1/1980 | James et al. | |
| 4,220,176 | A * | 9/1980 | Russell | 137/496 |
| 4,291,722 | A * | 9/1981 | Churchman | 137/496 |
| 4,340,088 | A | 7/1982 | Geisow | |
| 4,411,316 | A | 10/1983 | Carmody | |
| 4,478,286 | A | 10/1984 | Fineberg | |
| 4,605,070 | A | 8/1986 | Morris | |
| 4,726,422 | A | 2/1988 | Helderle et al. | |
| 4,838,355 | A | 6/1989 | Leismer | |
| 4,846,281 | A | 7/1989 | Clary et al. | |
| 4,926,945 | A | 5/1990 | Pringle et al. | |
| 5,145,005 | A | 9/1992 | Dollison | |
| 5,310,005 | A | 5/1994 | Dollison | |
| 5,564,675 | A | 10/1996 | Hill, Jr. et al. | |
| 5,819,853 | A | 10/1998 | Patel | |
| 6,196,261 | B1 | 3/2001 | Dennistoun | |
| 6,227,299 | B1 | 5/2001 | Dennistoun | |
| 7,637,326 | B2 * | 12/2009 | Bolding et al. | 166/375 |
| 7,673,689 | B2 | 3/2010 | Jackson et al. | |
| 7,798,229 | B2 | 9/2010 | Vick, Jr. et al. | |
| 8,002,040 | B2 | 8/2011 | May et al. | |
| 8,047,294 | B2 | 11/2011 | Vick, Jr. et al. | |
| 8,479,826 | B2 * | 7/2013 | Vick, Jr. | E21B 34/06 166/319 |
| 2002/0033262 | A1 | 3/2002 | Musselwhite et al. | |
| 2003/0000582 | A1 | 1/2003 | Jackson | |
| 2003/0047314 | A1 | 3/2003 | Allamon | |
| 2003/0155131 | A1 | 8/2003 | Vick, Jr. | |
| 2003/0173091 | A1 * | 9/2003 | Horne | E21B 34/08 166/386 |
| 2006/0162939 | A1 | 7/2006 | Vick, Jr. et al. | |
| 2010/0294370 | A1 * | 11/2010 | Patterson et al. | 137/1 |
| 2010/0294508 | A1 * | 11/2010 | Xu et al. | 166/373 |
| 2010/0294509 | A1 | 11/2010 | Kim et al. | |
| 2013/0098631 | A1 | 4/2013 | Vick, Jr. | |

FOREIGN PATENT DOCUMENTS

| | | | |
|---|---|---|---|
| GB | 811237 | A | 4/1959 |
| GB | 2220963 | A | 1/1990 |
| WO | 199855732 | A | 12/1998 |
| WO | 2013058756 | A1 | 4/2013 |

OTHER PUBLICATIONS

Office Action dated Jun. 25, 2007 for U.S. Appl. No. 11/041,393, 5 pages.

Office Action dated Apr. 15, 2010 for U.S. Appl. No. 11/041,393, 4 pages.

Office Action dated Feb. 16, 2011 for U.S. Appl. No. 12/857,869, 12 pages.

Office Action dated Jan. 10, 2013 for U.S. Appl. No. 13/633,273, 18 pages.

GB Search Report dated Dec. 10, 2004 for GB Patent Application No. 0417116.1, 1 page.

Written Opinion dated Apr. 21, 2006 for PCT Patent Application No. PCT/US05/046166, 6 pages.

International Preliminary Report on Patentability dated Aug. 2, 2007 for PCT Patent Application No. PCT/US05/046166, 8 pages.

Examiner's Answer dated Feb. 1, 2008 for U.S. Appl. No. 11/041,393, 11 pages.

International Search Report and Written Opinion dated Jul. 12, 2012 for PCT Patent Application No. PCT/US2011/057117, 10 pages.

Baker Oil Tools, "Baker 'M' Series Non-Elastometric Valves", informational publication, undated, 4 pages.

* cited by examiner

PROTECTION OF A SAFETY VALVE IN A SUBTERRANEAN WELL

CROSS-REFERENCE TO RELATED APPLICATION APPLICATIONS

This application is a continuation of U.S. application Ser. No. 13/633,273 filed on 2 Oct. 2012, which claims the benefit under 35 USC § 119 of the filing date of International Application Serial No. PCT/US11/57117, filed 20 Oct. 2011. The entire disclosures of these prior applications are incorporated herein by this reference.

BACKGROUND

This disclosure relates generally to equipment utilized and operations performed in conjunction with a subterranean well and, in one example described below, more particularly provides for protection of a safety valve.

Safety valves perform a vital function in conjunction with well operations—preventing undesired release of fluids from the well. Unfortunately, a safety valve could become damaged due to one or more actual slam closures in a well. However, it is very difficult to test safety valves for slam closure performance at surface facilities which can simulate extreme well conditions (pressure, temperature, flow rate, etc.), if such facilities are even available.

A safety valve can also become damaged by wireline or slickline tools, coiled tubing strings and other objects which are passed through the safety valve while it is closed. For these reasons and others, improvements are continually needed in the art of providing protection for safety valves.

SUMMARY

A safety valve system for use in a subterranean well is described below. In one example, the system can include a safety valve protector connected downstream of a safety valve. When closed, the safety valve protector can reduce a flow rate through the safety valve and prevent displacement of an object through the safety valve protector to the safety valve.

Another safety valve system is provided to the art by this disclosure. The system can include a safety valve protector which, when closed, reduces a flow rate through a safety valve. The safety valve protector can close in response to the flow rate through the safety valve being above a predetermined level.

Yet another safety valve system can have each of the safety valve protector and the safety valve comprising an actuator, with the actuators being connected by a line. A signal transmitted by the line can cause the safety valve protector actuator to close the safety valve protector, and then cause the safety valve actuator to close the safety valve.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
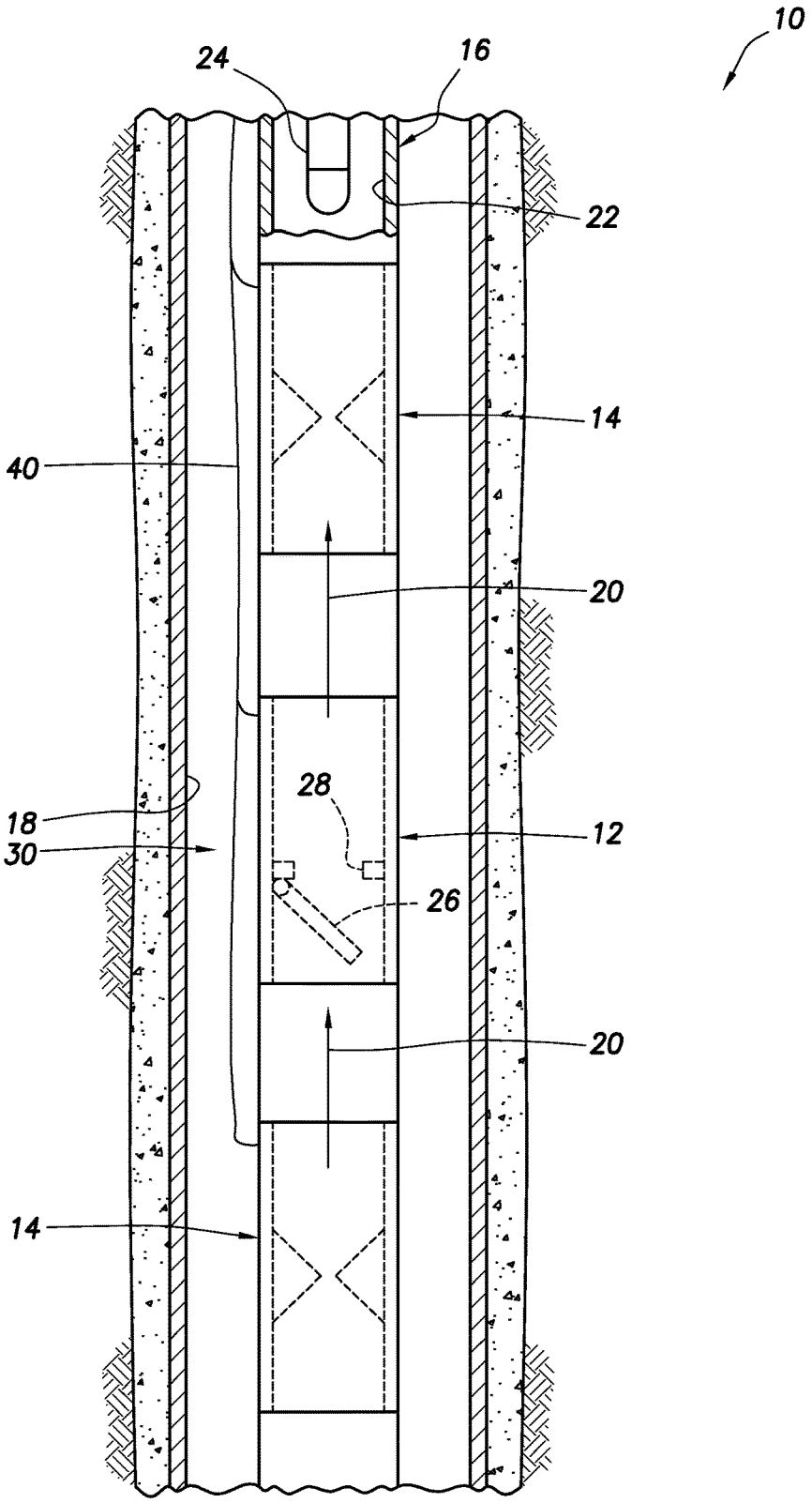
FIG. 1 is a representative partially cross-sectional view of a well system and associated method which can embody principles of this disclosure.

Representatively illustrated in FIG. 1 is a well system 10 and associated method which can embody principles of this disclosure. In the example depicted in FIG. 1, a safety valve 12 is connected downstream of one safety valve protector 14, and upstream of another safety valve protector. The safety valve 12 and safety valve protectors 14 are interconnected in a tubular string 16 (such as a production tubing string, liner string, etc.) positioned in a wellbore 18.

Flow 20 through an internal longitudinal passage 22 of the tubular string 16 passes through the safety valve 12 and the safety valve protectors 14. Thus, by restricting a rate of flow 20 through one of the safety valve protectors 14, a rate of flow through the safety valve 12 can also be restricted.

Although two of the safety valve protectors 14 are depicted in FIG. 1 it is contemplated that, typically, only one of the safety valve protectors would be used in practice. However, either or both of the safety valve protectors 14, or any other number of safety valve protectors may be used, in keeping with the scope of this disclosure.

One advantage of connecting a safety valve protector 14 downstream of the safety valve 12 (with respect to the flow 20), is that if the safety valve protector is suitably designed, it can prevent an object 24 (such as, a wireline or slickline tool, a coiled tubing string, a ball, a dart or plug, etc.) from striking a closure member 26 of the safety valve 12. The closure member 26 in this example comprises a flapper. However, in other examples, other types of closure members (such as balls, plugs, etc.) may be used.

In this configuration, the safety valve protector 14 would preferably be connected between the safety valve 12 and the earth's surface along the wellbore 18 (e.g., the safety valve protector is not necessarily vertically between the safety valve and the earth's surface, since the wellbore could be horizontal, highly deviated, etc.). The safety valve protector 14 can, thus, both protect the safety valve 12 from the object 24 displaced through the passage 22, and protect the safety valve from closing against an unacceptably high flow rate through the passage.

Closing the safety valve 12 while a high flow rate exists in the passage 22 can cause the closure member 26 to slam closed against a seat 28. Such a slam closure (or multiple slam closures), if sufficiently severe, can damage the safety valve 12. One benefit to reducing the flow rate through the safety valve 12 prior to closing the safety valve, is that the severity of a slam closure will be significantly reduced due to the reduced flow rate.

However, it should be understood that it is not necessary for a safety valve protector within the scope of this disclosure to both protect the safety valve against an object, and protect the safety valve against damaging slam closures. Instead, in other examples the safety valve protector 14 could only protect against slam closures or objects, one safety valve protector could protect against objects and another safety valve protector could protect against excessive flow rates, etc. Thus, it should be understood that the scope of this disclosure is not limited at all to the details of the safety valve protector 14 examples described herein.

Figure 2:
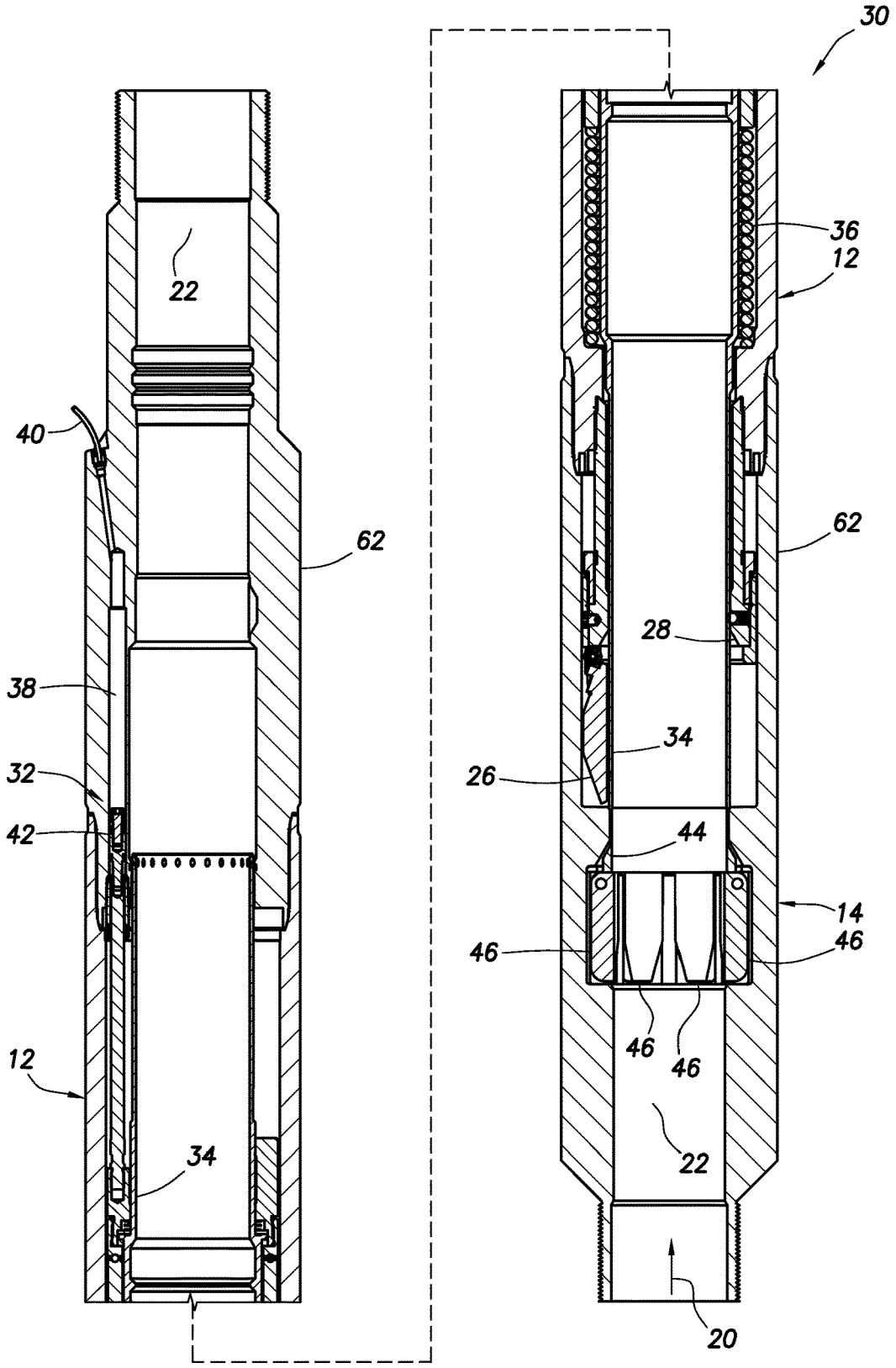
FIG. 2 is a representative cross-sectional view of a safety valve system which can embody principles of this disclosure.

Referring additionally now to FIG. 2, a safety valve system 30 which may be used in the well system 10 and method of FIG. 1 is representatively illustrated. Of course, the safety valve system 30 may be used in other well systems and methods, and remain within the scope of this disclosure.

The safety valve system 30 desirably combines the safety valve 12 and the safety valve protector 14 into a single assembly. In this manner, the safety valve 12 and safety valve protector 14 can share the same actuator 32, and can be operated sequentially by the same operating member 34 (such as a flow tube or opening prong, etc.).

However, it is not necessary for a safety valve and a safety valve protector to be combined into a single assembly, to share an actuator, or to be operated by the same operating member. In other examples, separate actuators and separate operating members may be used for actuating a safety valve and a safety valve protector.

In the FIG. 2 example, a biasing device 36 (such as a coiled spring, pressurized gas chamber, etc.) applies an upwardly biasing force to the operating member 34. Pressure transmitted to a chamber 38 via a line 40 can increase a pressure differential across a piston 42, thereby applying a greater downwardly (as viewed in FIG. 2) biasing force to the operating member 34, and displacing the operating member to the open position depicted in FIG. 2.

In the FIG. 2 open position, the operating member 34 retains the closure member 26 in a downwardly-pivoted open position, in which flow 20 through the passage 26 is relatively unrestricted. If, however, pressure in the line 40 and chamber 38 is reduced, the biasing force exerted by the biasing device 36 will displace the operating member 34 upward, thereby allowing the closure member 26 to pivot upward into sealing contact with the seat 28, thereby preventing upward flow 20 through the passage 22.

The safety valve protector 14 is also operated by the operating member 34, as mentioned above. In the FIG. 2 open position, the operating member 34 applies a downwardly biasing force to another operating member 44, which maintains multiple pivotably mounted blocking members 46 in open positions thereof.

In their FIG. 2 open positions, the members 46 do not significantly block the passage 22. However, when the operating member 34 displaces upward (e.g., due to the biasing force exerted by the device 36 becoming greater than the biasing force exerted by a pressure differential across the piston 42), the operating member 44 can also displace upward, thereby allowing the blocking members 46 to pivot inward and upward into the passage 22, thereby increasingly blocking the passage.

Figure 4:
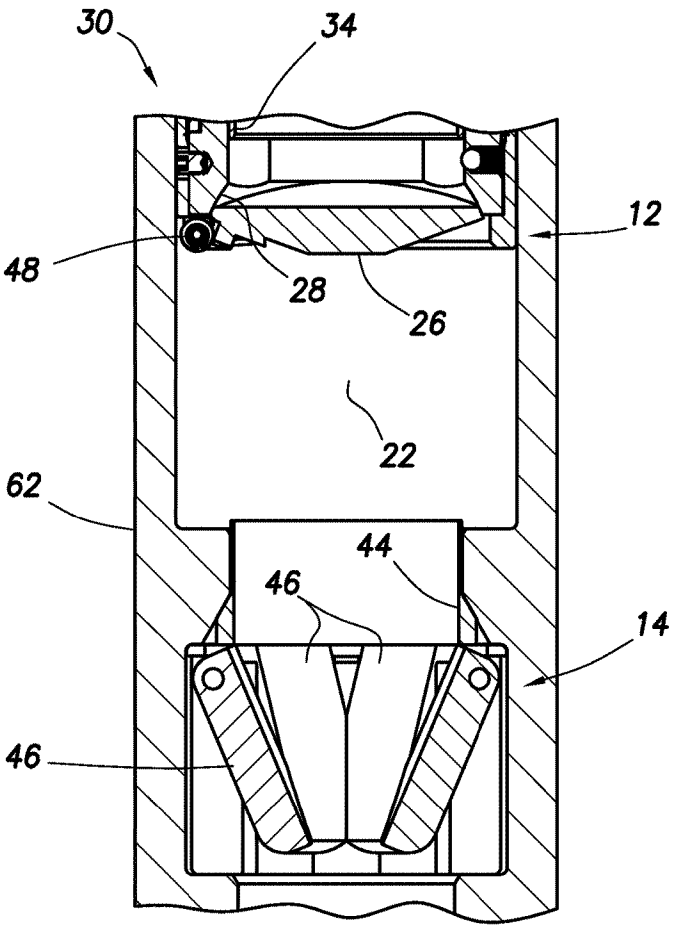
FIGS. 3 & 4 are representative cross-sectional views of a safety valve and safety valve protector of the safety valve system, in respective open and closed positions.
Figure 3:
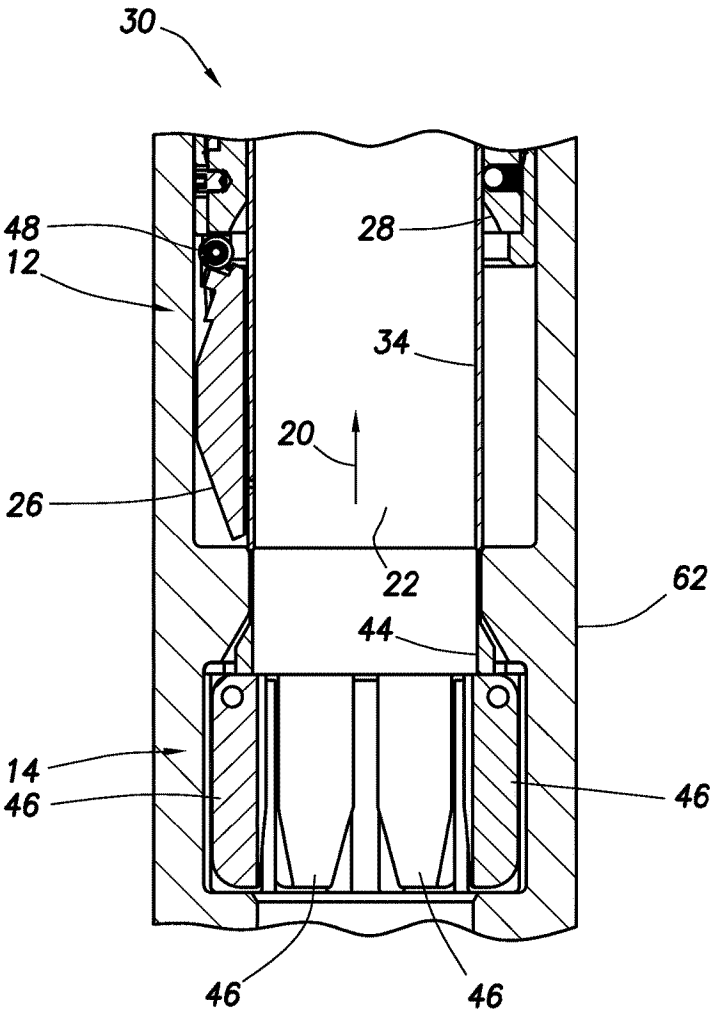

Referring additionally now to FIGS. 3 & 4, enlarged scale views of the operating members 34, 44, closure device 26 and blocking members 46 are representatively illustrated in open and closed positions. In FIG. 3, the operating members 34, 44 are in their downwardly disposed open positions, maintaining the closure device 26 and blocking members 46 in their downwardly and outwardly pivoted open positions. In FIG. 4, the operating members 34, 44 are in their upwardly disposed open positions, thereby allowing the closure device 26 and blocking members 46 to pivot inwardly and upwardly to their open positions.

In FIG. 4, the blocking members 46 significantly reduce the rate of the flow 20 through the system 30, prior to the closure device 26 sealingly engaging the seat 28. Preferably, the operating member 44 displaces and permits the blocking members 46 to pivot inward before the operating member 34 displaces sufficiently to allow the closure member 26 to pivot inward.

Thus, the rate of the flow 20 can be significantly reduced by the blocking members 46 prior to the closure device 26 displacing to its closed position. The closure device 26 and blocking members 46 can be biased to pivot inward and upward by biasing devices 48 (such as torsion springs, leaf springs, Belleville washers, etc.).

Note that, in the FIGS. 2-4 example, the safety valve protector 14 is connected below the safety valve 12. However, in other examples, the blocking members 46 and operating member 44 could be connected above the safety valve, both above and below the safety valve, etc.

Figure 5:
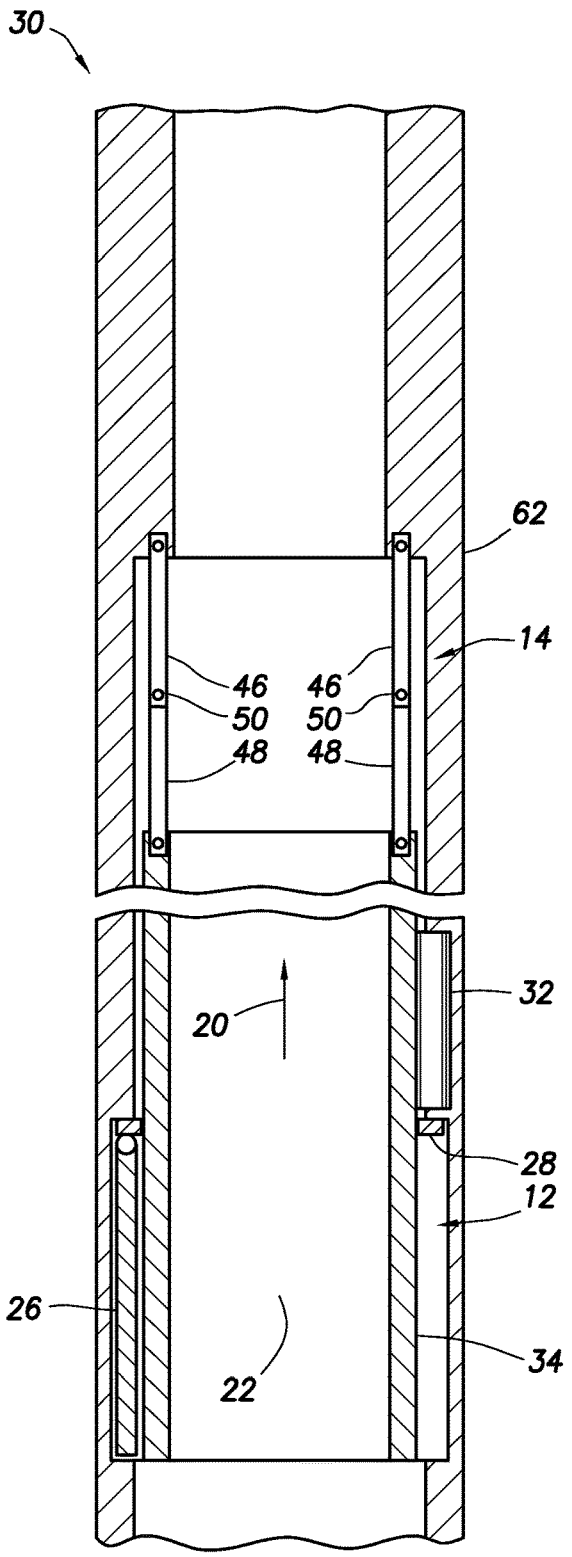
FIGS. 5 & 6 are representative cross-sectional views of another configuration of the safety valve system, in respective open and closed positions.
Figure 6:
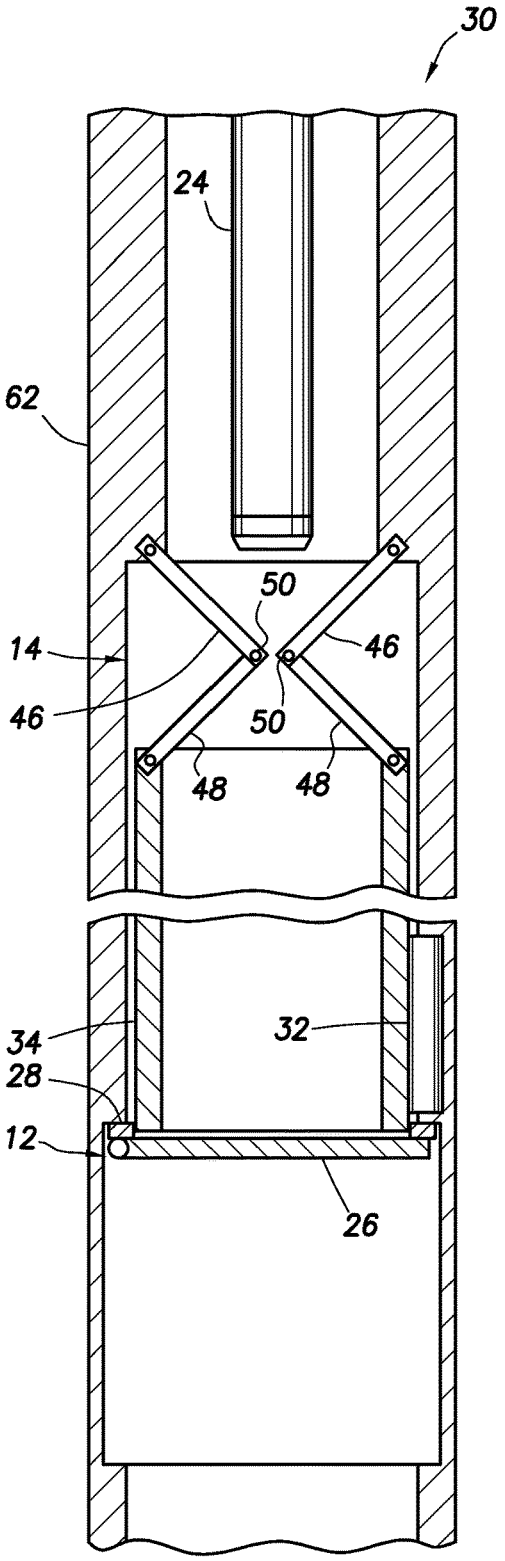

Referring additionally now to FIGS. 5 & 6, another configuration of the safety valve system 30 is representatively illustrated in respective open and closed positions. This configuration is similar in some respects to the configuration of FIGS. 2-4, but differs at least in that the safety valve protector 14 is connected above the safety valve 12, and additional blocking members 48 are pivotably connected to the blocking members 46 and pivotably connected to the operating member 34.

A separate operating member 44 is not used in the FIGS. 5 & 6 example. Instead, the blocking members 46, 48 in this example immediately begin to pivot inward when the operating member 34 displaces upward toward its closed position.

A pivot 50 which rotatably connects the blocking members 46, 48 displaces inward as the operating member 34 displaces upward. The blocking members 46, 48 all pivot inward, but the blocking members 46 pivot upwardly, and the blocking members 48 pivot downwardly from their open positions, when the operating member 34 displaces upward.

In the closed configuration, the blocking members 46, 48 can prevent displacement of the object 24 through the safety valve protector 14 to the safety valve 12. The blocking members 46, 48 can also reduce the rate of flow 20 through the passage 22, prior to the closure device 26 sealingly engaging the seat 28.

Figure 7:
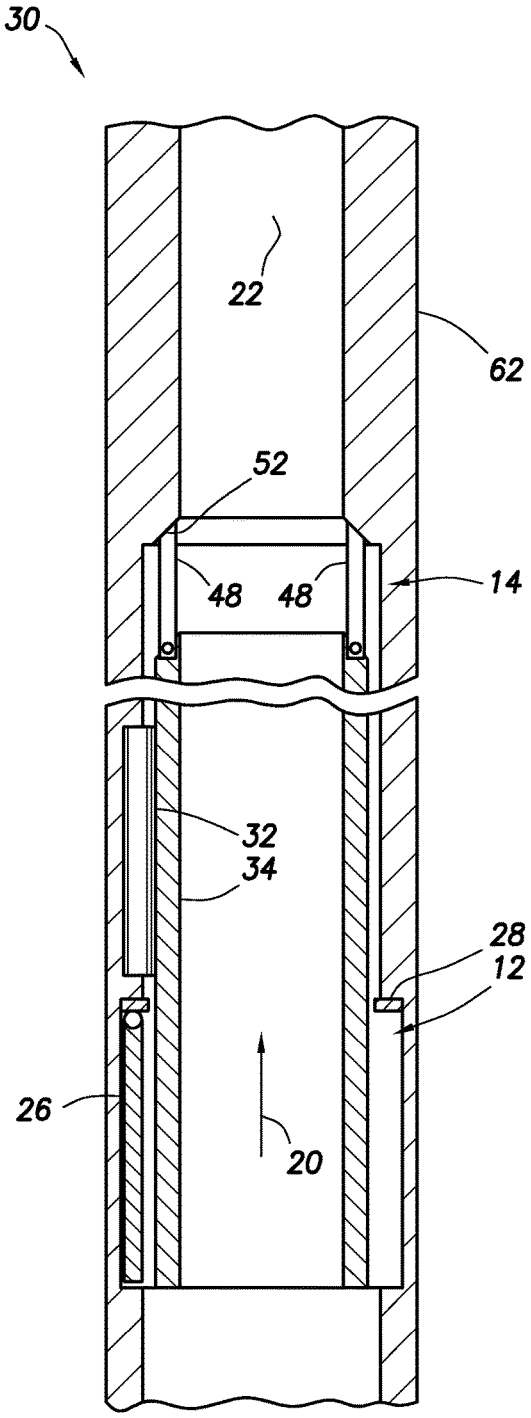
FIGS. 7 & 8 are representative cross-sectional views of another configuration of the safety valve system, in respective open and closed positions.
Figure 8:
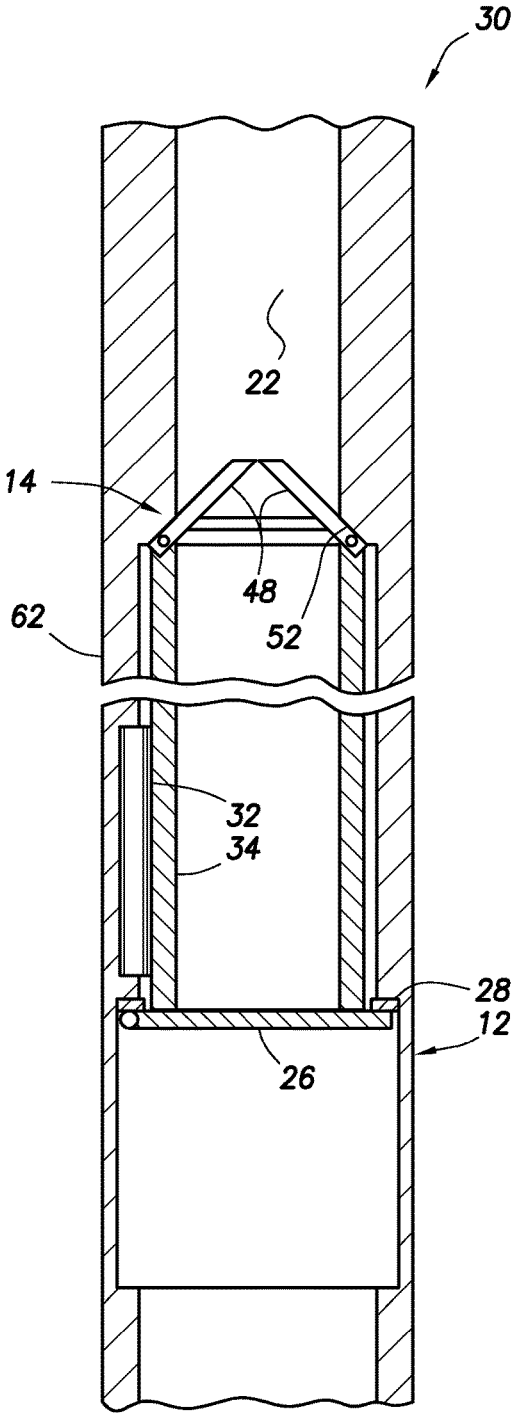

In addition, the increased blocking of the flow 20 by the members 48, 46 from the FIG. 7 to the FIG. 8 configuration can apply an upwardly biasing force to the operating member 34. This increased biasing force acting on the operating member 34 (e.g., in addition to the biasing force provided by the actuator 32) can enable the operating member to rapidly accelerate upward, without blocking the closure device's 26 upward pivot to the seat 28. This can help prevent damage to the closure device 26 and/or its pivot, hinge, pin, etc.

The actuator 32 in FIGS. 5 & 6 could include the piston 42 and chamber 38 of the FIG. 2 configuration. However, in other examples, the actuator 32 could comprise an electric motor, magnetic devices, a linear actuator, or any other type of actuator (in which case the line 40 could be an electrical, optical, hydraulic or other type of line). The scope of this disclosure is not limited to any particular type of actuator.

Referring additionally now to FIGS. 7 & 8, another configuration of the safety valve system 30 is representatively illustrated in respective open and closed positions. This configuration is similar in some respects to the configuration of FIGS. 5 & 6, but differs at least in that the blocking members 46 are not pivotably attached to the blocking members 48.

Instead, the blocking members 48 are pivoted inwardly by an inclined surface 52 formed in a body 62. For example, the blocking members 48 can be biased outward with biasing devices (such as torsion springs, leaf springs, etc.), so that they are maintained in their FIG. 7 open positions, and pivot inward to their FIG. 8 closed positions when the operating member 34 is displaced upward. The blocking members 48 can also, or alternatively, be biased outward by the flow 20 through the passage 22 in the open position of FIG. 7.

The blocking members 48 in their inwardly and downwardly pivoted FIG. 8 closed positions can prevent the object 24 from displacing downward through the safety valve protector 14 to the safety valve 12. In addition, in some examples, the blocking members 48 can reduce the rate of flow 20 through the passage 22 prior to the closure device 26 sealingly engaging the seat 28.

Figure 9:
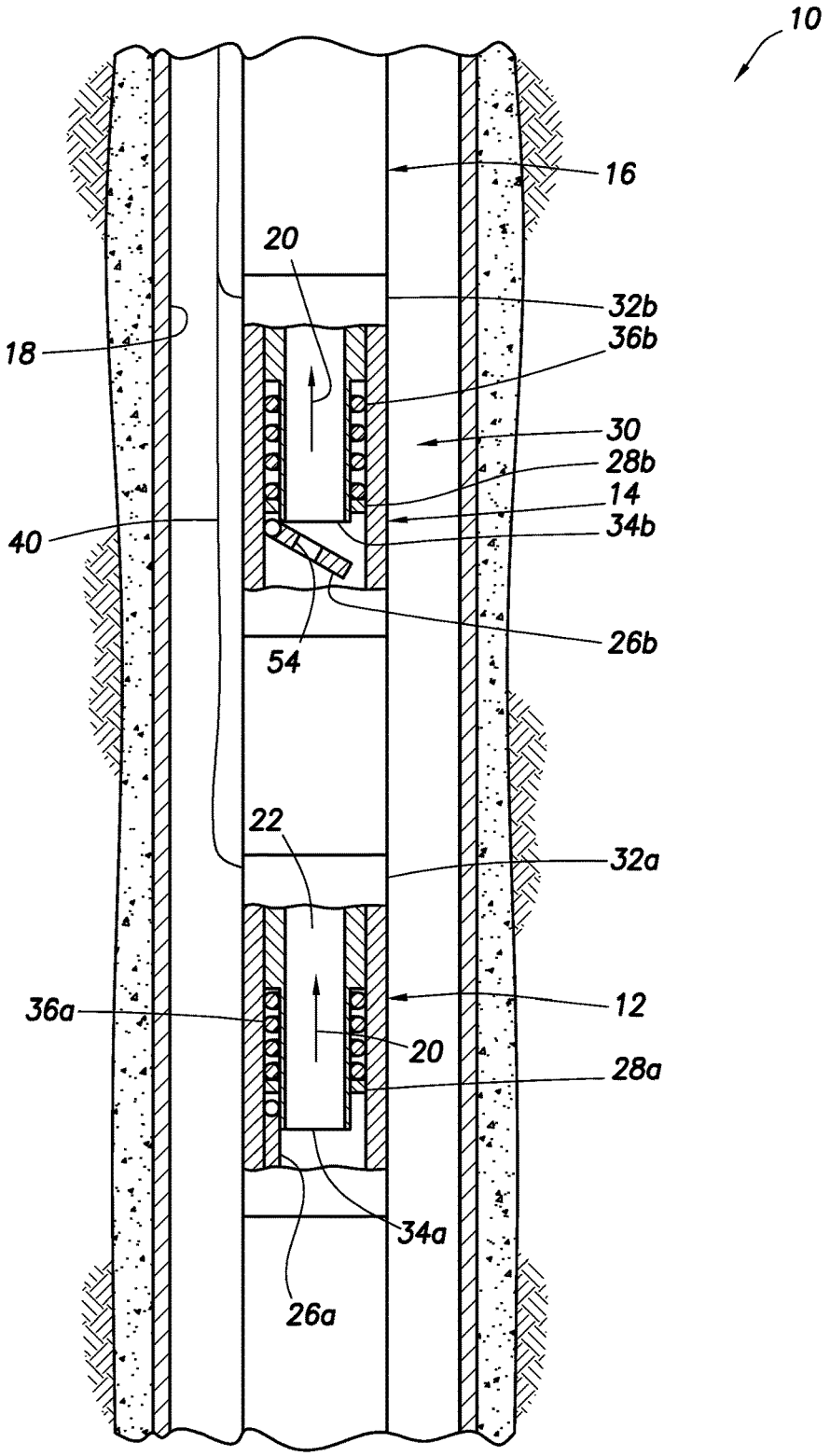
FIG. 9 is a representative cross-sectional view of another configuration of the safety valve system.

Referring additionally now to FIG. 9, another configuration of the safety valve system 30 installed in the well system 10 is representatively illustrated. In this configuration, the safety valve protector 14 is connected above the safety valve 12, and is similar in many respects to the safety valve, but in other examples the safety valve protector could be connected upstream and/or downstream of the safety valve and could be differently configured.

In the FIG. 9 configuration, each of the safety valve 12 and safety valve protector 14 includes a closure device 26*a,b*, a seat 28*a,b*, an actuator 32*a,b* and an operating member 34*a,b*. However, there can be significant differences between the elements of the safety valve 12 and those of the safety valve protector 14.

For example, the closure device 26*b* of the safety valve protector 14 can have one or more openings 54 therein which permit flow 20 through the closure device, even though the closure device is engaged with the seat 28*b*. In addition, it is not necessary for the closure device 26*b* to sealingly engage the seat 28*b*. Thus, in this example, the closure device 26*b* with the opening(s) 54 therein comprises a blocking member which, in the closed position, reduces the rate of the flow 20 through the passage 22.

In the FIG. 9 example, preferably the actuators 32*a,b* are both connected to the same line 40, so that pressure in the line is communicated to the chambers 38 of both actuators. In this manner, substantially the same pressure is applied to the safety valve actuator 32*a* as is applied to the safety valve protector actuator 32*b* via the line 40.

To ensure that the safety valve protector 14 closes and, thus, reduces the rate of the flow 20 through the passage 22 prior to the closure device 26*a* sealingly engaging the seat 28*a*, the safety valve protector is differently configured from the safety valve 12. In the FIG. 9 example, this is accomplished by configuring the safety valve protector 14 so that it closes at a higher pressure level in the line 40, as compared to the pressure level in the line at which the safety valve 12 closes.

For example, the biasing device 36*b* of the safety valve protector 14 can exert a greater biasing force as compared to the biasing device 36*a* of the safety valve 12. This greater biasing force of the biasing device 36*b* can close the safety valve protector 14 (e.g., by upwardly displacing the operating member 34*b*) while pressure in the line 40 is greater than the pressure at which the biasing device 36*a* of the safety valve 12 will close the safety valve.

As another example, the piston 42 of the safety valve protector actuator 32*b* could have a smaller piston area (or fewer pistons could be used, resulting in a smaller total piston area) as compared to the piston(s) of the safety valve actuator 32*a*. In this manner, a pressure differential across the piston(s) 42 of the safety valve protector 14 will exert less biasing force as compared to the piston(s) of the safety valve 12, so that the safety valve protector will close prior to the safety valve closing.

Although the safety valve protector 14 depicted in FIG. 9 is similar in some respects to the safety valve 12, other types of safety valve protectors can be used, if desired. For example, the safety valve protector 14 could be configured similar to a ball valve, butterfly valve, or other type of flow control device which can be designed (e.g., so that the ball valve or butterfly valve only partially shuts off flow through the passage, or so that the ball valve or butterfly valve has an opening in its closure member, etc.) to reduce the rate of flow 20 through the passage 22 prior to the safety valve 12 closing.

Figure 10:
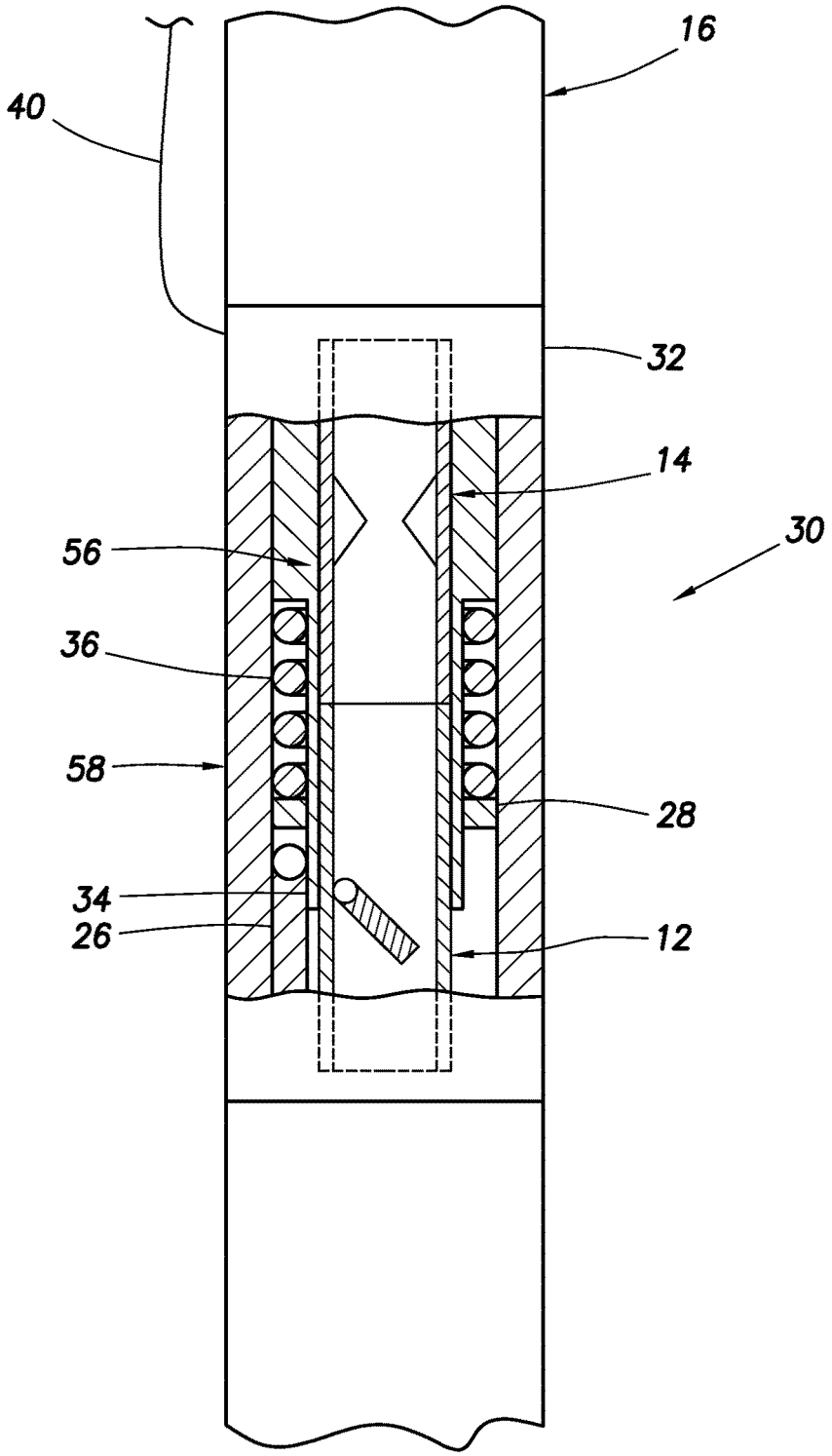
FIG. 10 is a representative cross-sectional view of yet another configuration of the safety valve system.

Referring additionally now to FIG. 10, another configuration of the safety valve system 30 is representatively illustrated. In this configuration, the safety valve 12 and safety valve protector 14 are combined into an insert valve assembly 56, which is installed in an outer safety valve 58 interconnected in the tubular string 16.

It will be appreciated by those skilled in the art that, when an insert safety valve is used in an outer safety valve, the insert safety valve typically will have a reduced capability of closing against flowing fluids, and at a same flow rate the insert safety valve will have a greater fluid velocity therein due to a reduced flow area, etc. By combining the safety valve protector 14 with the safety valve 12 in the insert valve assembly 56, the rate of flow 20 through the assembly can be reduced, prior to the safety valve closing.

Preferably, the safety valve 12 and safety valve protector 14 are operable via the line 40 upon installation in the outer safety valve 58. Those skilled in the art are aware of a variety of ways in which an insert safety valve can be operated (e.g., hydraulically, electrically, etc.), and so these techniques are not described further herein. Any manner of operating the safety valve 12 and safety valve protector 14 may be used (whether or not the safety valve protector is operated via the line 40), in keeping with the scope of this disclosure.

Figure 11:
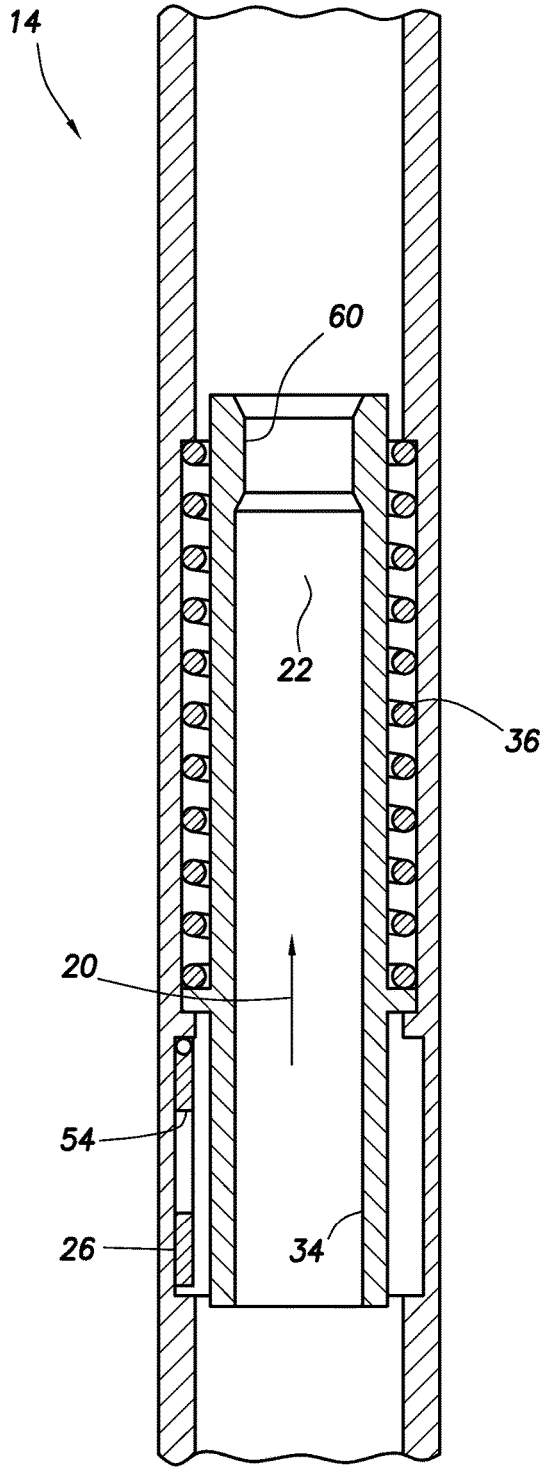
FIGS. 11 & 12 are representative cross-sectional views of another configuration of the safety valve protector, in respective open and closed positions.
Figure 12:
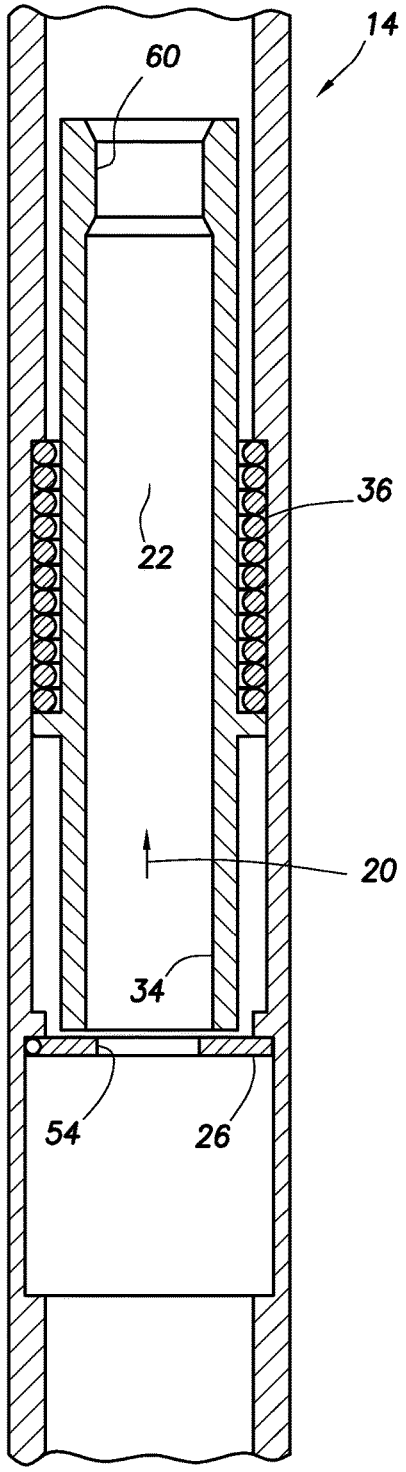

Referring additionally now to FIGS. 11 & 12, another configuration of the safety valve protector 14 is representatively illustrated in respective open and closed positions. The FIGS. 11 & 12 safety valve protector 14 configuration may be used for any of the other safety valve protectors described herein.

The FIGS. 11 & 12 safety valve protector 14 is similar in many respects to the safety valve protector of FIG. 9, but differs at least in that a flow restriction 60 is used instead of the actuator 32 to operate the safety valve protector to its open position, and the biasing device 36 is used to downwardly (instead of upwardly) bias the operating member 34. Flow 20 through the flow restriction 60 creates a pressure differential across the flow restriction, which upwardly biases the operating member 34.

When the upwardly biasing force due to the flow 20 through the flow restriction 60 exceeds the downwardly biasing force exerted by the biasing device 36 (e.g., at a predetermined flow rate), the operating member 34 can displace from its FIG. 11 open position to its FIG. 12 closed position in which the rate of the flow through the passage 22 is reduced. When the downwardly biasing force exerted by the biasing device 36 (e.g., at less than the predetermined flow rate) exceeds the upwardly biasing force due to the flow 20 through the flow restriction 60, the operating member 34 can displace from its FIG. 12 closed position to its FIG. 11 open position in which the rate of the flow through the passage 22 is increased.

In this example, the decreased rate of the flow 20 in the closed position is due to the reduced flow area through the opening 54 in the closure member 26, but in other examples the blocking members 46 and/or 48 or other flow reducing elements could be used, etc. The safety valve protector 14 of FIGS. 11 & 12 may be connected upstream or downstream of the safety valve 12.

The flow restriction 60 in the FIGS. 11 & 12 configuration comprises a reduced flow area attached to the operating member 34, but in other examples the flow restriction could be formed by a tortuous flow path, by whiskers or another surface treatment which does not significantly obstruct the passage 22, etc. Any manner of displacing the operating member 34 in response to the flow 20 through the passage 22 may be used in keeping with the scope of this disclosure.

It may now be fully appreciated that this disclosure provides significant advancements to the art of protecting safety valves in wells. In several examples described above, the safety valve protector 14 is automatically operated to reduce a rate of flow 20 through the safety valve 12, prior to the safety valve closing. In several examples, the safety valve protector 14 can protect the safety valve 12 from an object displaced through the passage 22 toward the safety valve.

A safety valve system 30 for use in a subterranean well is described above. In one example, the system 30 can include a safety valve protector 14 connected downstream of a safety valve 12, whereby when closed the safety valve protector 14 reduces a flow rate through the safety valve 12 and prevents displacement of an object 24 through the safety valve protector 14 to the safety valve 12.

The safety valve protector 14 can comprise a blocking member 48 which is pivotably attached to an operating member 34 of the safety valve 12. The blocking member 48 may pivot when the operating member 34 displaces. The blocking member 48 may pivot in an upstream direction when the operating member 34 displaces.

The safety valve protector 14 can include multiple blocking members 46, 48 pivotably attached to each other at a pivot 50. The pivot 50 may displace inward when an operating member 34 of the safety valve 12 displaces. The blocking members 48 can be pivotably attached to the operating member 34.

The safety valve protector 14 and the safety valve 12 can be included in an insert valve assembly 56. The insert valve assembly 56 may be positioned within an outer safety valve 58.

Also described above is a safety valve system 30 which, in one example, can include a safety valve protector 14 which, when closed, reduces a flow rate through a safety valve 12. The safety valve protector 14, in this example, closes in response to the flow rate through the safety valve 12 being above a predetermined level.

The safety valve protector 14 can open in response to the flow rate through the safety valve 12 being reduced below the predetermined level.

The safety valve protector 14 can comprise a flow restriction 60, whereby flow 20 through the flow restriction 60 biases an operating member 34 to displace against a force exerted by a biasing device 36.

Displacement of the operating member 34 may cause a blocking member 26, 46, 48 to partially block flow 20 through a flow passage 22 of the safety valve protector 14.

The blocking member 26 may comprise a flapper having at least one opening 54 which permits flow 20 through the flow passage 22 when the flapper is in a closed position.

The safety valve protector 14 may be connected upstream and/or downstream of the safety valve 12.

The safety valve protector 14 and the safety valve 12 may be included in an insert valve assembly 56.

The system of claim 17, wherein the insert valve assembly is positioned within an outer safety valve.

The above disclosure also provides to the art a safety valve system 30 which, in one example, can include a safety valve protector 14 which, when closed, reduces a flow rate through a safety valve 12. In this example, each of the safety valve protector 14 and the safety valve 12 comprises an actuator 32*a,b*, the actuators 32*a,b* being connected by a line 40. A signal transmitted by the line 40 can cause the safety valve protector actuator 32*b* to close the safety valve protector 14, and then cause the safety valve actuator 32*a* to close the safety valve 12.

The signal may comprise a reduced pressure in the line 40.

The safety valve protector actuator 32*b* may include a biasing device 36*b* which exerts a greater biasing force as compared to a biasing force exerted by a biasing device 36*a* of the safety valve actuator 32*a*.

A piston 42 of the safety valve protector actuator 32*b* may be biased by the safety valve protector actuator biasing device 36*b* against pressure in the line 40 which acts on the safety valve protector actuator piston 42, and a piston 42 of the safety valve actuator 32*a* may be biased by the safety valve actuator biasing device 36*a* against the pressure in the line 40 which acts on the safety valve actuator piston 42.

Also described above is a method of operating a safety valve system 30. In one example, the method can include providing a safety valve protector 14 which, when closed, reduces a flow rate through a safety valve 12, with each of the safety valve protector 14 and the safety valve 12 comprising an actuator 32*a,b*, the actuators 32*a,b* being connected by a line 40, and the safety valve protector actuator 32*b* closing the safety valve protector 14, and then the safety valve actuator 32*a* closing the safety valve 12, in response to a reduced pressure in the line 40.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A safety valve system for use in a subterranean well, the system comprising: a safety valve protector downstream of a safety valve, whereby the safety valve protector is closed automatically at the same time the safety valve is closed, wherein the safety valve protector comprises two blocking members pivotably attached to each other at a pivot, wherein the pivot displaces inward to a position only partially blocking flow through the valve protector when an operating member of the safety valve displaces.

2. The system of claim 1, wherein one of the two blocking members is pivotably attached to the operating member of the safety valve.

3. The system of claim 2, wherein the two blocking members pivot when the operating member displaces.

4. The system of claim 2, wherein one of the two blocking members pivots upstream when the operating member displaces.

5. The system of claim 1, wherein the safety valve protector and the safety valve are included in an insert valve assembly.

6. The system of claim 5, wherein the insert valve assembly is positioned within an outer safety valve.

7. The system of claim 1, wherein the two blocking members are a first set of blocking members and the pivot is a first pivot, wherein the safety valve protector comprises a second of set of two blocking members pivotably attached to each other at a second pivot, wherein the second pivot displaces inward toward the first pivot to a position only partially blocking flow through the valve protector when the operating member of the safety valve displaces.

* * * * *